US005088669A

United States Patent [19]

Zinnbauer

[11] Patent Number: 5,088,669

[45] Date of Patent: Feb. 18, 1992

[54] FURNITURE EXTREMITY

[75] Inventor: Jerry Zinnbauer, Charlotte, N.C.

[73] Assignee: Technimark, Inc., Greensboro, N.C.

[21] Appl. No.: 685,824

[22] Filed: Apr. 15, 1991

[51] Int. Cl.[5] ..... A47B 91/00

[52] U.S. Cl. ..... 248/188.9; 248/188; 403/359

[58] Field of Search ..... 248/615, 616, 677, 188.2, 248/188.8, 188.9, 188; 16/29, 43; 403/359, 334

[56] References Cited

U.S. PATENT DOCUMENTS

| | | | |
|---|---|---|---|
| 645,974 | 3/1900 | Reed . | |
| 670,937 | 4/1901 | McCauley . | |
| 706,337 | 8/1902 | Nickel et al. . | |
| 918,083 | 4/1904 | Palmer . | |
| 1,148,666 | 8/1915 | Eberhart | 220/352 X |
| 1,229,831 | 6/1917 | Vonderlin . | |
| 1,338,249 | 7/1919 | Overmyer . | |
| 1,439,149 | 12/1922 | Crandall . | |
| 1,482,660 | 2/1924 | Overmyer . | |
| 1,869,279 | 7/1932 | Reed . | |
| 2,458,621 | 1/1949 | Miller | 248/188.9 X |
| 2,631,330 | 3/1953 | Becker . | |
| 2,670,226 | 2/1954 | Becker . | |
| 2,687,547 | 8/1954 | Matter . | |
| 2,973,546 | 3/1961 | Roche | 16/43 |
| 3,197,802 | 8/1965 | Fontana et al. . | |
| 3,210,795 | 10/1965 | Fontana et al. . | |
| 3,356,327 | 12/1967 | Schreyer | 248/188.8 X |
| 3,401,908 | 9/1968 | Rapata | 248/188.8 |
| 3,640,496 | 2/1972 | Duncan | 248/188.9 |
| 4,819,402 | 4/1989 | Schneider | 403/359 X |
| 4,923,158 | 5/1990 | Saisho | 248/188.8 |
| 5,007,607 | 4/1991 | Kim | 248/615 X |

FOREIGN PATENT DOCUMENTS

| | | | |
|---|---|---|---|
| 1263332 | 5/1961 | France | 248/188.8 |

*Primary Examiner*—J. Franklin Foss
*Attorney, Agent, or Firm*—Rhodes, Coats & Bennett

[57] ABSTRACT

A furniture foot connection includes an item of furniture having a lower portion with a given thickness and a hole in the lower portion having a given diameter and a furniture foot including a body and a hollow stem. The stem has a length greater than the thickness of the lower portion of the item of furniture and a diameter slightly larger than the diameter of the hole. The stem extends through the hole so that the body of the foot is adjacent the lower portion and a length of the stem extends above the lower portion. The lower portion of the furniture compresses the hollow stem within the hole, and the length of the hollow stem extending above the lower portion is uncompressed to open to a diameter greater than the diameter of the hole. This secures the foot in place on the lower portion. The stem has a plurality of ribs with differing asymmetrical profiles which inhibit rotation of the foot in the hole in either direction.

20 Claims, 1 Drawing Sheet

FURNITURE EXTREMITY

BACKGROUND OF THE INVENTION

The present invention relates to improvements in securing extremities, particularly feet, to items of furniture.

The retail furniture business has become extremely competitive in recent years, especially in the high volume/low price realm, so manufacturers are constantly searching for ways to reduce costs. Two methods often employed are material substitution and reduction of cube (volume) in shipping. While new materials can be substituted for internal components, little has been done to reduce cube in shipping because the products' standard size and image are usually not changeable.

One of the few places that both cost savings actions can be employed is in the feet used on such items as easy chairs and sofas. These feet have traditionally been wood but, in recent times, lower cost plastic feet have been substituted. The production and material costs for plastic feet are much lower on a per unit basis. Plastic feet can be added to the furniture after it has been shipped, so that the cube of the shipped product is reduced. Also, because of the nature of plastic, a small shaft or stem can be formed at the top of the foot. The stem can be driven into holes in the furniture frame, thereby speeding up the assembly process. A stem of similar small section cannot be formed in wood because it would be too weak to withstand the side pressure to which it would be exposed. In addition, it would not be resilient and have the memory to "grasp" the hole into which it is inserted. Accordingly, there is a need in the art for a plastic foot design that can be successfully driven into the furniture frame and not turn or work loose.

SUMMARY OF THE INVENTION

The present invention fulfills this need in the art by providing a furniture extremity for mounting on a furniture leg which has a bottom face with a hole. The extremity includes a body for ground engagement and a stem extending from the body and having a plurality of radially extending ribs thereon. The ribs have differing asymmetrical profiles. When the stem is inserted into the hole in the furniture leg, the ribs engage the inside face of the hole and the differing asymmetrical profiles of the ribs inhibit rotation of the extremity in the hole in either direction. Preferably, the stem has a beveled distal portion to assist in centering the stem in the hole during insertion.

It is also preferable that the ribs are tapered and the stem is hollow. Preferably, the body, stem and ribs are unitary and formed of molded plastic. In order to increase the securement of the ribs in the hole, the ribs should have a hardness of at least about the hardness of 8 melt polyethylene.

In a preferred embodiment, the ribs have profiles with radial faces, one of which extends outwardly further radially than the other and a tangential face extends from one radial face to the other such that an intersection of the tangential face and the further extending radial face forms an acute angle. It is also desirable for alternate ones of the ribs to have their acute angle intersection on a leading edge considering clockwise movement of the stem in the hole.

Preferably, the body is cup-shaped with an inside center and a rim. The stem extends upward from the inside center and the rim is adapted to engage the bottom face of the furniture leg. More preferably, the cup has a side wall and a radial web extending from the stem to the side wall, and the rim has a slot aligned with the radial web so that the insertion of a tool into the slot facilitates prying the extremity from the leg.

In another aspect, the invention provides a furniture foot for mounting on a furniture leg having a bottom face with a hole including a molded unitary item including a body, a tapered stem, and ribs extending along the stem.

Regarded from another perspective, the invention provides a furniture foot connection. The connection includes an item of furniture having a lower portion with a given thickness and a hole in the lower portion having a given diameter and a furniture foot including a body and a hollow stem. The stem has a length greater than the thickness of the lower portion of the item of furniture and a diameter slightly larger than the diameter of the hole. The stem extends through the hole so that the body of the foot is adjacent the lower portion and a length of the stem extends above the lower portion. The lower portion of the furniture compresses the hollow stem within the hole, and the length of the hollow stem extending above the lower portion is uncompressed to open to a diameter greater than the diameter of the hole. This secures the foot in place on the lower portion.

From yet another perspective, the invention provides a furniture foot for mounting on an item of furniture which has a bottom face with a hole. The foot includes a body portion for floor engagement and a stem for secure, press-fix engagement in the hole in the bottom face of the item of furniture. The body portion includes a vertical radial web having an upper edge which is juxtaposed the bottom face when the furniture foot is mounted on the furniture. The body portion has a gap aligned with the web in which a prying means may be inserted to pry the furniture foot off of the item of furniture.

BRIEF DESCRIPTION OF THE DRAWINGS

This invention will be better understood after a reading of the Detailed Description of the Preferred Embodiment and a review of the drawings in which.

DETAILED DESCRIPTION OF A PREFERRED EMBODIMENT

Figure 1:
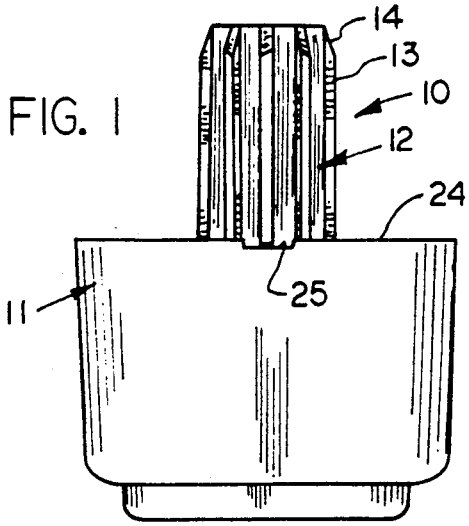
FIG. 1 is an elevational view of a furniture foot according to the invention.

FIG. 1 shows my new locking furniture foot. While the description hereinafter will be with respect to a foot for a piece of furniture, the invention is applicable to various furniture extremity connections, including connections of casters and the like. The foot 10 is constructed by plastic molding and is made in one piece in the molding process. Making the foot as a unitary whole provides economy of manufacture while assuring maximum strength.

Figure 2:
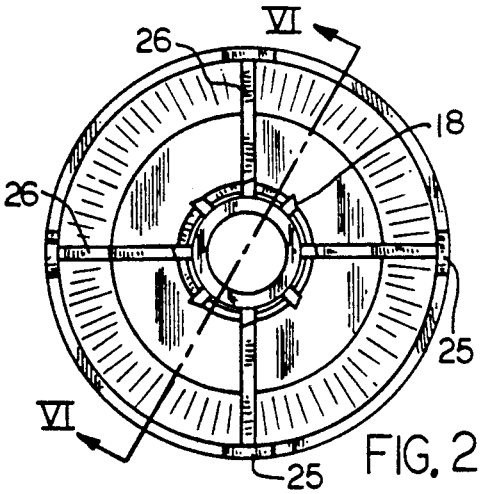
FIG. 2 is a top plan view of the furniture foot of FIG. 1.
Figure 3:
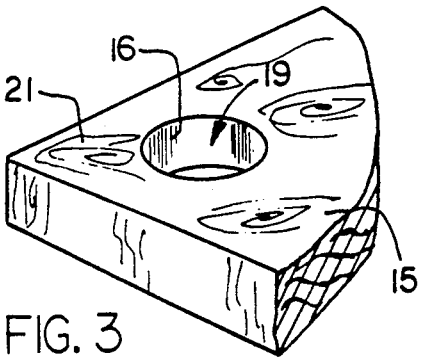
FIG. 3 is a perspective view of a portion of an item of furniture having a hole therein for receiving the furniture foot of FIG. 1.
Figure 6:
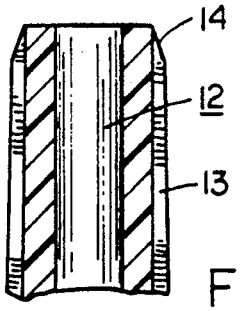
FIG. 6 is a sectional view through the stem of the furniture foot of FIG. 2 taken along lines VI—VI and looking in the direction of the arrows.
Figure 7:
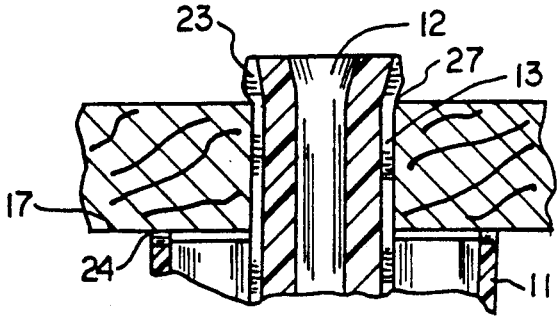
FIG. 7 is a sectional view similar to FIG. 6, showing in exaggerated form the deformation of the stem while inserted into the furniture portion of FIG. 3.

Foot 10 includes an outer body or visible shell 11 and a stem or shaft 12. Body 11 is cup-shaped and includes radial webs 26 (see FIG. 2) connecting the stem 12 and the bottom and side walls of the cup. Stem 12 is meant to be inserted through a hole 19 in a wooden furniture frame 21 depicted generally in FIG. 3. Hole 19 has an inside face 16. The furniture frame 21 is typically made of wood. Because the stem 12 must be slightly tapered to be molded as part of the body 11, ribs 13 are molded as part of the stem 12 in order to have contact with the sides of the hole 19. A stem having the full diameter of hole 19 could not be forced through the hole. However, the ribs 13 can be and are made to define a diameter slightly larger than hole 19. Also, the stem 12 is made hollow, as seen in FIGS. 2 and 6.

Stem 12 has a lead-in bevel 14 to assist in its alignment with hole 19. When the stem is aligned, body 11 is struck by any suitable heavy object on its lower surface 17 until the upper surface 14 of the body 11 makes contact with surface 15 of the furniture frame 21 and can go no further.

Figure 4:
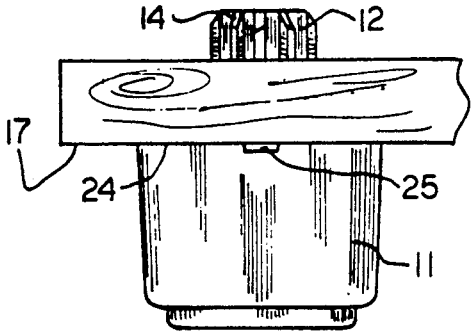
FIG. 4 is an elevational view of the foot in the furniture portion of FIG. 3.
Figure 5:
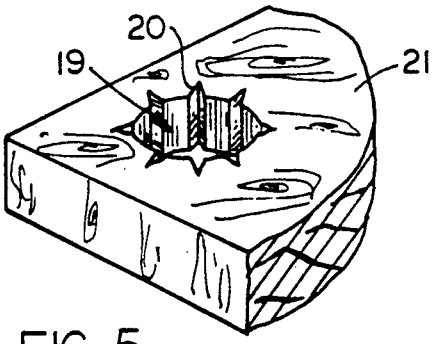
FIG. 5 is a perspective view similar to FIG. 3 after removal of the furniture foot.

When the stem 12 is driven through hole 19 to its maximum extent, as seen in FIG. 4, the ribs 13 etch or cut into the softer wood surface 16 of the inside of hole 19, since they extend radially further than hole 19. Ribs 13 make a permanent indentation on surface 16 identical to the shape of the ribs, as seen in FIG. 5. When the foot 10 has been inserted fully for at least a small portion of time the natural memory of the wood of the frame 21 conforms tightly to the sides 16 of hole 19. This conformation helps the foot 10 remain on the furniture frame 21. But this is, in some cases, not enough. If the foot 10 sustains sufficient side pressure or is in any way turned, then the helpful ribs 13 of the stem 12 act as a ream to enlarge the hole 19, greatly reducing the grip on the stem 12.

The present invention avoids this difficulty however. The ribs 13 are provided with angled outer faces 18. The angled outer faces form an acute angle with one of the radial faces of the rib, and adjacent ribs have their acute angles oppositely oriented. This one rib prevents clockwise rotation and another prevents counterclockwise rotation. When forced through hole 19, the faces 18 form angled slots 20 in the wall surface 16 which do not permit the furniture foot 10 to be turned, so the reaming effect does not occur. Other asymmetrical profiles for the ribs 13 may be substituted as long as they inhibit rotation and are provided in opposite pairs to inhibit rotation in both directions.

Also aiding in the snug fit of the furniture foot 10 to the frame 21 is the fact that stem 12 is hollow, like a tube shown in FIGS. 2 and 6. When the stem 12 is driven through the frame 21 as shown in FIG. 4, a portion 23 of the stem 12 protrudes through the frame 21. As mentioned above, the ribs 13 extend radially to a greater extent than the diameter of hole 19. As the stem 12 is driven through the hole 19, its diameter is compressed slightly by the hole. When the compressed stem 12 passes beyond the constraining surface 27, it is again allowed to find its original diameter 23, which is larger than the diameter of hole 19. The restoration of the diameter is assisted by the fact that the foot 10 is made from a flexible plastic material and causes the foot 10 to be more securely held in the seated position.

After insertion of the stem 12, there may be a need to remove the foot 10. Removal is greatly hindered because of the strong grip and secure hold of the frame 21 on stem 12. When it does become necessary to remove the foot 10, as in a moving activity for example, this can be accomplished. Slots or gaps 15 are provided located over the webs 26. Into these slots 15 a small rigid blade, such as that of a screwdriver (see FIG. 6), can be inserted to pry the leg out of the hole 19 in frame 21. Slots 15 are positioned over the webs 26 so that the rigid ribs can be used to pry against.

The preferred material for the foot is a hard polyethylene, with a hardness of 8 melt or lower. The frame is typically wooden, and the polyethylene is hard enough to make the cuts in the wood illustrated in FIG. 5. That illustration is, of course, a bit exaggerated for clarity. Other material combinations providing the same properties may be substituted.

Thus, shipping and material costs can be reduced by making the furniture foot as described herein and shipping the furniture to the customer with these feet unattached. The feet can be easily attached by the customer, and they will stay attached until intentionally removed, as described.

While a preferred embodiment of the invention has been described as illustrated, as will be apparent, the invention can be carried out in various forms.

What is claimed is:

1. A furniture extremity for mounting on a furniture leg which has a bottom face with a hole comprising:

a body for ground engagement, a stem extending from said body and having a plurality of radially extending ribs thereon, said ribs having profiles, which are asymmetrical about a vertical radial plane through their midsections and which differ from one rib to another, whereby said stem may be inserted into the hole in the furniture leg so that said ribs engage the inside face of the hole and the differing asymmetrical profiles of the ribs inhibit rotation of the extremity in the hole in either direction.

2. An extremity as claimed in claim 1 wherein said stem has a beveled distal portion to assist in centering said stem in the hole during insertion.

3. An extremity as claimed in claim 1 wherein said ribs are tapered.

4. An extremity as claimed in claim 1 wherein said stem is hollow.

5. An extremity as claimed in claim 1 wherein said body, stem and ribs are unitary and formed of molded plastic.

6. An extremity as claimed in claim 1 wherein said ribs have a hardness of at least about the hardness of 8 melt polyethylene.

7. An extremity as claimed in claim 1 wherein said ribs have profiles with radial faces, one of which extends outwardly further radially than the other and a tangential face extends from one radial face to the other such than an intersection of said tangential face and said further extending radial face forms an acute angle.

8. An extremity as claimed in claim 7 wherein alternate ones of said ribs have said intersection on a leading edge considering clockwise movement of said stem in the hole.

9. An extremity as claimed in claim 1 wherein said body is cup-shaped with an inside center and rim with said stem extending upward from the inside center, and said rim adapted to engage the bottom face of the furniture leg.

10. An extremity as claimed in claim 9 in which said cup has a side wall and a radial web extending from said stem to said side wall and said rim has a slot aligned with said radial web so that the insertion of a tool into said slot facilitates prying the extremity from the leg.

11. A furniture foot for mounting on a furniture leg having a bottom face with a hole comprising a molded, unitary item including a body shaped for floor engagement, a tapered stem, and ribs extending along said stem, said ribs having a hardness of at least about the hardness of 8 melt polyethylene.

12. A foot as claimed in claim 11 wherein said stem has a beveled distal portion to assist in centering said stem in the hole during insertion.

13. A foot as claimed in claim 11 wherein said stem is hollow.

14. A foot as claimed in claim 11 wherein said body is cup-shaped with an inside center and rim with said stem extending upward from the inside center, and said rim adapted to engage the bottom face of the furniture leg.

15. A furniture foot connection comprising an item of furniture having a lower portion with a given thickness and a hole in said lower portion having a given diameter, a furniture foot including a body and a hollow stem, said stem having a length greater than the thickness of said lower portion of said item of furniture and a diameter slightly larger than the diameter of the hole, said stem diameter being substantially uniform along the entire stem length except perhaps for an enlarging taper towards the body, and extending through said hole so that the body of the foot is adjacent said lower portion and a length of said stem extends above said lower portion whereby said lower portion of the furniture compresses said hollow stem within said hole and the length of said hollow stem extending above said lower portion is uncompressed to open to a diameter greater than the diameter of the hole, to secure the foot in place on the lower portion.

16. A foot connection as claimed in claim 15 wherein said stem has a beveled distal portion to assist in centering said stem in the hole during insertion.

17. A foot as claimed in claim 15 wherein said body and stem are unitary and formed of molded plastic.

18. A foot as claimed in claim 15 wherein said body is cup-shaped with an inside center and rim, said stem extends upward from the inside center, and said rim engages said lower portion.

19. A foot as claimed in claim 18 in which said cup has a side wall and a radial web extending from said stem to said side wall and said rim has a slot aligned with said radial web so that the insertion of a tool into said slot facilitates prying the foot from said lower portion.

20. A furniture foot for mounting on an item of furniture which has a bottom face with a hole comprising:

a body portion for floor engagement and a stem for secure, press-fix engagement in the hole in the bottom face of the item of furniture, said body portion including a vertical radial web having an upper edge which is juxtaposed the bottom face when the furniture foot is mounted on the furniture, and said body portion having a gap aligned with said web into which a prying means may be inserted to pry the furniture foot off of the item of furniture.

* * * * *